United States Patent [19]

Guy

[11] Patent Number: 4,757,544

[45] Date of Patent: Jul. 12, 1988

[54] MULTI-DIRECTIONAL SPEAKER SYSTEM

[75] Inventor: Dennis D. Guy, Marianna, Fla.

[73] Assignee: Steven P. Surgnier, Marianna, Fla.

[21] Appl. No.: 941,763

[22] Filed: Dec. 15, 1986

[51] Int. Cl.[4] ..... H04R 1/02

[52] U.S. Cl. ..... 381/90; 381/205; 439/13; 439/21

[58] Field of Search ..... 439/5, 13, 17, 1, 21; 381/8, 24, 88, 89, 90, 205

[56] References Cited

U.S. PATENT DOCUMENTS

| | | | |
|---|---|---|---|
| 3,014,192 | 12/1961 | Leslie | 439/5 |
| 4,015,887 | 4/1977 | Ross et al. | 439/21 |
| 4,139,734 | 2/1979 | Fincham | 381/192 |
| 4,441,577 | 4/1984 | Kurihara | 381/86 |

FOREIGN PATENT DOCUMENTS

| | | | |
|---|---|---|---|
| 1538462 | 1/1979 | United Kingdom | 439/5 |

*Primary Examiner*—Forester W. Isen
*Attorney, Agent, or Firm*—A. W. Fisher, III

[57] ABSTRACT

A multi-directional speaker system for use in combination with a sound source comprising an adjustable speaker support structure to operatively support a plurality of speakers each operable within a discrete frequency range and an electrically conductive path to feed electric signals from the sound source to each of the plurality of speakers wherein the adjustable speaker support structure includes a lower rotatable speaker support and an upper pivotal speaker support coupled thereto to operatively support a lower and upper speaker respectively and the electrically conductive path includes a lower conductive interface to receive electric signals from the sound source and intermediate and upper conductive interface each electrically coupled to the lower conductive interface to feed electric signals therefrom to the lower and upper speakers respectively.

9 Claims, 1 Drawing Sheet

FIG. 1
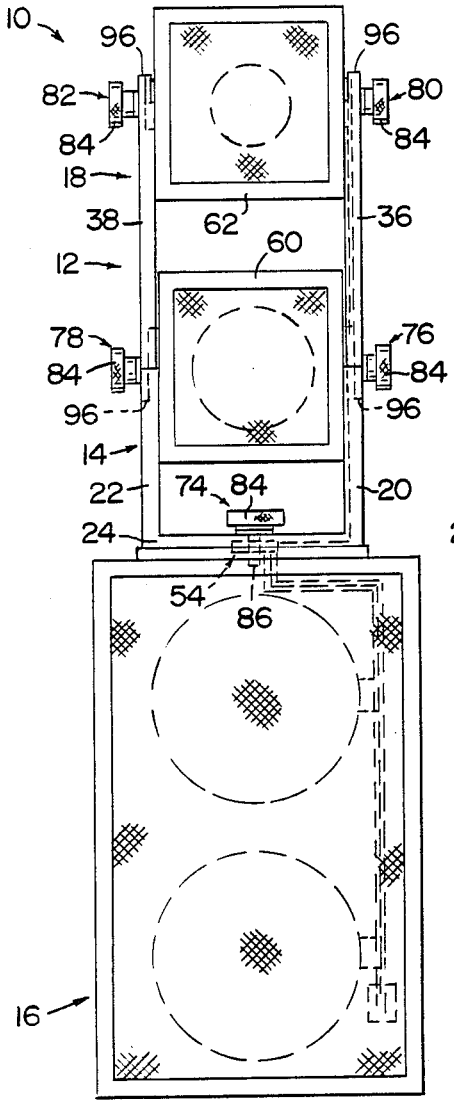
FIG. 2
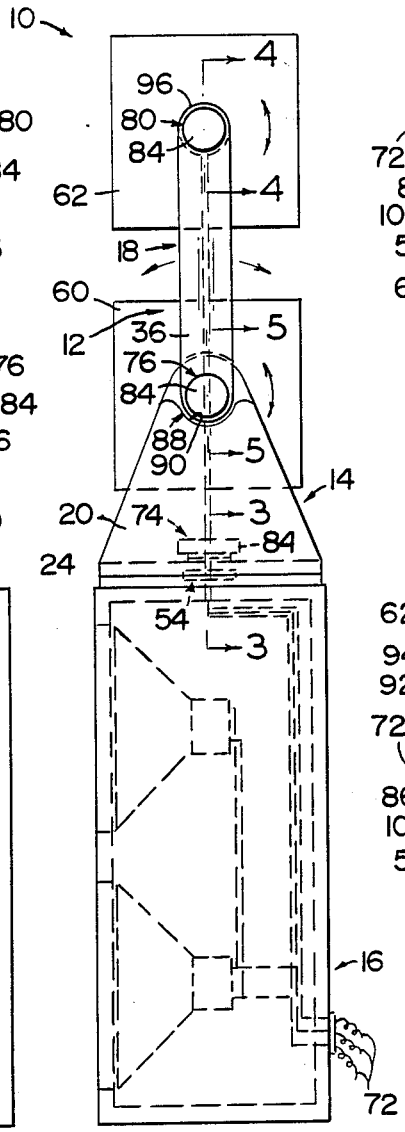
FIG. 4
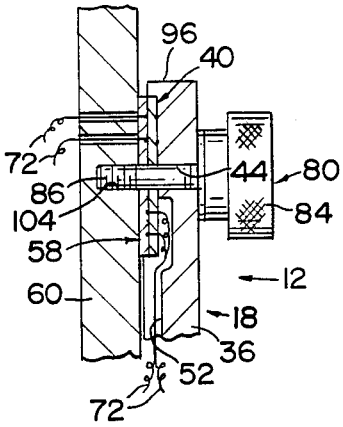
FIG. 5
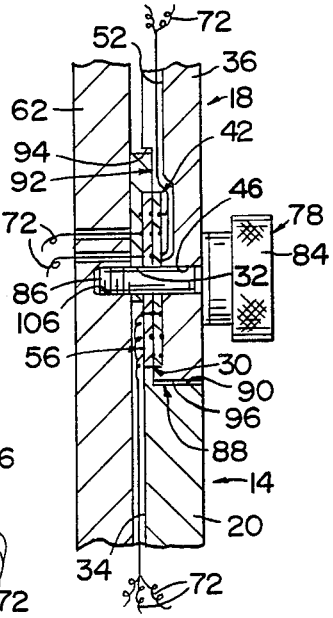
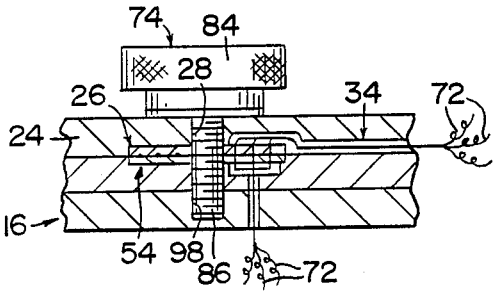
FIG. 3
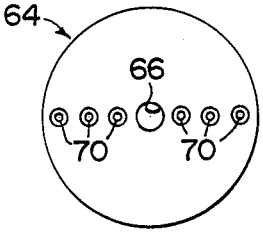
FIG. 6
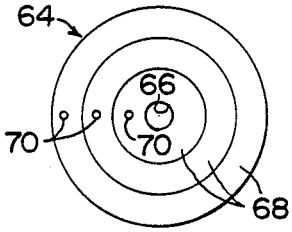
FIG. 7

MULTI-DIRECTIONAL SPEAKER SYSTEM

BACKGROUND OF THE INVENTION

1. Field of the Invention

A multi-directional speaker system for use in combination with a sound source comprising an adjustable speaker support structure to operatively support a plurality of speakers and an electrically conductive path to feed electric signals from the sound source to the plurality of speakers.

2. Description of the Prior Art

Numerous multi-speaker systems have been developed with the advent of high fidelity and stereophonic sound systems. While some such systems incorporate several speakers in a single cabinet, many such systems mount speakers of discrete frequency range in separate cabinets. This permits the user to position the speakers in various relative positions within a room. A few systems even provide rotatable speaker cabinets for ease of positioning or controlling the direction of sound.

Normally multi-speaker systems include separate speakers with a base range of 200 to 1600 hertz an upper mid-range of 1600 to 5000 hertz and a high range above 5000 hertz. Due to the omni directional travel of the lower frequency sounds and unidirectional travel of the higher frequency sounds reproduction of recorded sound fidelity is difficult without expensive advanced technologies.

Applicant has, however, found that by directing the separate speakers in various vertical and horizontal positions the resultant sounds closely resembles true fidelity.

SUMMARY OF THE INVENTION

The present invention relates to a multi-directional speaker system for use in combination with a sound source.

The multi-directional speaker system comprises an adjustable speaker support structure to operatively support a plurality of speakers each operable within a discrete frequency range and an electrically conductive path to feed electric signals from the sound source to each of the plurality of speakers.

The adjustable speaker support structure comprises a lower substantially U-shaped speaker support rotatably mounted on a base and an upper speaker support including a pair of substantially parallel upper speaker support members pivotally coupled to the upper portion of the lower substantially U-shaped speaker support.

The electrically conductive path comprises a lower, intermediate and upper conductive interface disposed in operative relationship relative to the sound source, lower substantially U-shaped speaker support and upper speaker support respectively to feed electric signals from the sound source to the speakers supported by the lower substantially U-shaped speaker support and upper speaker support. Each conductive interface comprises a pair of circular conductive element rotatably disposed in electrically conductive engagement relative to each other. Each circular conductive element includes a plurality of conductive surfaces to receive discrete electric signals from the sound source. In use, the entire multi-directional speaker system may be rotated in the horizontal plane on the lower speaker support while the speakers operatively supported by the lower speaker support and upper speaker support may be pivoted in the vertical plane to any desired position independent of each other. In this manner, the listener is able to position the various speakers relative to each other to enhance the sound reproduction.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which:

FIG. 1 is a front view of the multi-directional speaker system.

FIG. 2 is a side view of the multi-directional speaker system.

FIG. 3 is a detailed partial cross-sectional view taken along line 3—3 of FIG. 2.

FIG. 4 is a detailed partial cross-sectional view taken along 4—4 of FIG. 2.

FIG. 5 is a detailed partial cross-sectional view taken along line 5—5 of FIG. 2.

FIG. 6 is a bottom view of the circular conductive element.

FIG. 7 is a top view of the circular conductive element.

Similar reference characters refer to similar parts throughout the several views of the drawings.

DETAILED DESCRIPTION OF THE PREFERRED EMBODIMENT

As best shown in FIGS. 1 and 2, the present invention relates to a multi-directional speaker system generally indicated as 10 for use in combination with a sound source (not shown). The multi-directional speaker system 10 comprises an adjustable speaker support structure generally indicated as 12 to operatively support a plurality of speakers each operable within a discrete frequency range and an electrically conductive path as more fully described hereinafter to feed electrical signals from the sound source (not shown) to each of the plurality of speakers.

The adjustable speaker support structure 12 comprises a lower speaker support generally indicated as 14 rotatably mounted on a base generally indicated as 16 and an upper speaker support generally indicated as 18 pivotally coupled to the upper portion of the lower speaker support 14.

The lower speaker support 14, substantially U-shaped in configuration, comprises a first and second lower substantially parallel support element indicated as 20 and 22 respectively held in fixed space relationship relative to each other by a substantially horizontal interconnecting element 24.

As shown in FIG. 3, a centrally disposed recess 26 and concentrically aligned aperture 28 are formed in the substantially horizontal interconnecting element 24. Similarly as shown in FIG. 5, a first and second concentrically aligned recess and aperture indicated as 30 and 32 respectively are formed in the upper portion of the first and second vertical support elements 20 and 22 respectively.

A conductor channel 34 is formed on the inner surfaces of the substantially horizontal interconnecting element 24 and the first lower support element 20.

The upper speaker support 18 comprises a first and second upper substantially parallel vertical support element indicated as 36 and 38 pivotally coupled to the upper portion of the first and second lower substantially parallel support elements 20 and 22 respectively.

An upper and lower centrally disposed recess indicated as 40 and 42 respectively and a first concentrically aligned upper and lower aperture indicated as 44 and 46 respectively are formed in the upper and lower portions of the first upper support element 36. Similarly a second upper and lower concentrically aligned aperture respectively are formed in the second upper support element 38 in horizontal alignment with the first concentrically aligned upper and lower apertures 44 and 46 respectively. A conductor channel 52, formed on the inner surface of the first upper support element 36, extends between the upper and lower centrally disposed recesses 40 and 42.

The conductive path comprises a lower, intermediate and upper conductive interface generally indicated as 54, 56 and 58 respectively disposed in operative relationship relative to the sound source (not shown), lower speaker support 14 and upper speaker support 18 to feed electrical signals from the sound source (not shown) to the lower and upper speakers indicated as 60 and 62 respectively.

Specifically, as shown in FIGS. 6 and 7, each conductive interface 54, 56, and 58 comprises a pair of circular conductive elements each indicated as 64 having a centrally disposed aperture 66 formed therein rotatably disposed in electrical conductive engagement relative to each other. At least a portion of the lower, intermediate and upper interfaces 54, 56 and 58 are secured within the centrally disposed recess 26 and upper and lower centrally disposed recesses 36 and 38 respectively. Each circular conductive element 64 includes a plurality of conductive surfaces each indicated as 68 and a corresponding plurality of conductive contacts each indicated as 70 to receive discrete electrical signals from the sound source (not shown). The plurality of conductive surfaces 68 or tracks normally correspond to common, tweeter and upper mid-range frequencies. The conductive contacts 70 of the lower, intermediate and upper conductive interface 54, 56 and 58 are interconnected to the sound source (not shown) through a plurality of conductors each indicated as 72.

As best shown in FIGS. 1 and 3 through 5, the multi-directional speaker system 10 further includes an adjustable securing means comprising comprises a lower adjustable securing element, a first and second intermediate adjustable securing element, and a first and second upper adjustable securing element generally indicated as 74, 76, 78, 80 and 82 respectively. Each adjustable securing element 74, 76, 78, 80 and 82 comprises an enlarged member 84 and an elongated threaded element 86 extending outwardly therefrom to permit selective adjustment and securing of the lower speaker support 14 relative to the base 16, and the lower speaker 60 and the upper speaker support 18 relative to the lower speaker support 14, and the upper speaker 62 relative to the upper speaker support 18.

As best shown in FIGS. 1 and 2, the multi-directional speaker system 10 further includes a support interface comprising a notch 88 having a concave lower surface 90 formed on the upper portion of the first and second lower substantially parallel support elements 20 and 22 and notch 92 having a concave upper surface 94 formed on the lower portion of the first and second upper substantially parallel vertical support elements 36 and 38 in combination with corresponding convex end portions 96 formed on the upper portions of the first and second lower substantially parallel support elements 20 and 22 and on the lower portions of the first and second upper substantially parallel support elements 36 and 38 to permit rotation of the upper speaker support 18 relative to the lower speaker support 14.

In use, the multi-directional speaker system 10 is rotatably mounted on a base 16 which may comprise a speaker cabinet. The multi-directional speaker system 10 is rotated on the base 16 to the desired position and secured in place by the lower adjustable securing element 74, extending through the concentrically aligned aperture 28, centrally disposed recess 26 of the lower speaker support 14 and centrally disposed apertures 66 formed in the circular conductive elements 64 of the lower conductive interface 54 into an internally threaded channel 98 formed in the base 16. The lower speaker 58 and upper speaker support 18 are pivoted on the upper portion of the lower speaker support 14 and secured in place by the first and second intermediate adjustable securing elements 76 and 78. The first intermediate adjustable securing element 76 extends through the first concentrically aligned aperture 30 of the first lower support element 20, first lower concentrically aligned aperture 46 of the first upper support element 36, lower centrally disposed recess 42 of the upper speaker support 18 and centrally disposed apertures 66 formed in the circular conductive elements 64 of the intermediate conductive interface 56 into an internally threaded channel 100 formed on one side of the lower speaker 58. The second intermediate adjustable securing element 78 extends through the second concentrically aligned aperture 32 of the second lower support element 22 and second lower concentrically aligned aperture 46 of the second upper support element 38 into an internally threaded channel 102 formed on the opposite side of the lower speaker 58. The upper speaker 60 is then pivoted on the upper portion of the upper speaker support 18 and secured in place by the first and second upper adjustable securing elements 80 and 82. The first upper adjustable securing element 80 extends through the first concentrically aligned aperture 44 of the first upper support element 36, upper centrally disposed recess 40 of the upper speaker support 18 and centrally disposed apertures 66 formed in the circular conductive elements 64 of the upper conductive interface 58 into an internally threaded channel 104 formed on one side of the upper speaker 60. The second upper adjustable securing element 82 extends through the second concentrically upper aligned aperture 46 of the second upper support element 38 into an internally threaded channel 106 formed on the opposite side of the upper speaker 60.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A multi-directional speaker system for use in combination with a sound source comprising an adjustable speaker support structure to operatively support a plurality of speakers each operable within a discrete frequency range and an electrically conductive path to feed electric signals from the sound source to each of the plurality of speakers wherein said adjustable speaker support structure includes a lower speaker support rotatable mounted on a base and an upper speaker support pivotably coupled to said lower speaker support to operatively support a lower and upper speaker respectively and wherein said electrically conductive path includes a lower conductive interface to receive electric signals from the sound source and an intermediate and upper conductive interface each electrically coupled to the lower conductive interface to feed electric signals therefrom to the lower and upper speakers respectively; said electrically conductive path comprises said lower, intermediate and upper conductive interfaces disposed in an operative relationship relative to the sound source, a lower speaker support and an upper speaker support to feed electrical signals from the sound source to the lower and upper speakers; each said conductive interface comprises a pair of circular conductive elements rotatably disposed in electrical conductive engagement relative to each other; each said circular conductive element includes a plurality of conductive surfaces and a corresponding plurality of conductive contacts to receive discrete electrical signals from the sound source; said lower, intermediate and upper conductive interfaces are interconnected to the sound source through a plurality of conductors; said lower speaker support comprises a first and second lower substantially parallel support elements held in fixed space relationship relative to each other by a substantially horizontal interconnecting element, said substantially horizontal interconnecting element includes a centrally disposed recess formed therein to receive at least a portion of said lower conductive interface; said upper speaker support comprises a first and second upper substantially parallel support element pivotally coupled to the upper portions of said first and second lower substantially parallel support elements respectively and an upper and lower centrally disposed recess formed in the upper and lower portions of said first upper substantially parallel support member to receive at least a portion of said intermediate and upper conductive interfaces respectively each conductive interface having a centrally disposed aperature formed therein.

2. The multi-directional speaker system of claim 1 wherein a conductor channel is formed on the inner surfaces of said substantially horizontal interconnecting element and said first vertical support element of said lower speaker support extending between said centrally disposed recess formed in said lower speaker support and said lower centrally disposed recess of said upper speaker support to receive said plurality of conductors electrically interconnecting said lower and intermediate conductive interfaces.

3. The multi-directional speaker system of the claim 2 further including a conductor channel formed on the inner surface of said first upper support element of said upper speaker support extending between said upper and lower centrally disposed recess formed in said first upper support element to receive said plurality of conductors electrically interconnecting said intermediate and upper conductive interface.

4. The multi-directional speaker system of claim 3 further including adjustable securing means including a lower, first intermediate and first upper securing element disposed to selectively secure said lower speaker support relative to the base and the lower speaker and said upper speaker support relative to said lower speaker support and the upper speaker relative to said upper speaker support.

5. The multi-directional speaker system of claim 4 wherein said lower securing element comprises an externally threaded member extending through a concentrically aligned aperture formed in said substantially horizontal interconnecting element, said centrally disposed recess formed in said lower speaker support and said centrally disposed aperture formed in said lower conductive interface into an internally threaded channel formed in the base.

6. The multi-directional speaker system of claim 4 wherein said first intermediate adjustable securing element comprises an externally threaded member extending through a first concentrically aligned aperture formed in said first lower support element, said lower centrally disposed recess formed in first upper support element and centrally disposed aperture formed in said intermediate conductive interface into an internally threaded channel formed on one side of the lower speaker.

7. The multi-directional speaker system of claim 6 wherein said first upper adjustable securing element comprises an externally threaded member extending through said upper centrally disposed recess formed in said first upper support element and said centrally disposed aperture formed said upper conductive interface into an internally threaded channel formed on one side of the upper speaker.

8. The multi-directional speaker system of claim 7 further including a second intermediate adjustable securing element comprising an externally threaded member extending through a second concentrically aligned aperture formed in said second lower support element and a second lower concentrically aligned aperture formed in said second upper support element into an internally threaded channel formed in the lower speaker.

9. The multi-directional speaker system of claim 8 further including a second upper adjustable securing element comprising an externally threaded member extending through a second upper concentrically aligned aperture formed in said second upper support element into an internally threaded channel formed in the upper speaker.

* * * * *